US009500454B1

(12) United States Patent
Decker et al.

(10) Patent No.: US 9,500,454 B1
(45) Date of Patent: Nov. 22, 2016

(54) MORTAR PROJECTILE WITH GUIDED DECELERATION SYSTEM FOR DELIVERING A PAYLOAD

(71) Applicants: Ryan Decker, Hoboken, NJ (US); Oleg Yakimenko, Monterey, CA (US); Michael Hollis, Flanders, NJ (US); Douglas Chesnulovitch, Sparta, NJ (US); Raymond Chaplin, Hopatcong, NJ (US); Gary Dundon, Rockaway, NJ (US); Gregory Farbanish, Randolph, NJ (US)

(72) Inventors: Ryan Decker, Hoboken, NJ (US); Oleg Yakimenko, Monterey, CA (US); Michael Hollis, Flanders, NJ (US); Douglas Chesnulovitch, Sparta, NJ (US); Raymond Chaplin, Hopatcong, NJ (US); Gary Dundon, Rockaway, NJ (US); Gregory Farbanish, Randolph, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 14/596,767

(22) Filed: Jan. 14, 2015

(51) Int. Cl.

| | |
|---|---|
| ***F42B 10/56*** | (2006.01) |
| ***F42B 30/10*** | (2006.01) |
| *F42B 10/00* | (2006.01) |
| *F42B 30/00* | (2006.01) |

(52) U.S. Cl.
CPC ..... *F42B 10/56* (2013.01); *F42B 30/10* (2013.01)

(58) Field of Classification Search
CPC ..... F42B 10/32; F42B 10/48; F42B 10/56; F42B 30/08; F42B 30/10; F42B 10/02; F42B 10/04; F42B 10/06; F42B 10/14; F42B 10/16; F42B 30/12; F42B 12/02; F42B 12/36; F42B 12/46; F42B 12/50; F42B 12/52; F42B 12/56; F42B 12/58; F42B 12/62; F42B 12/64; F42B 15/01; F42B 15/10; F42B 15/105; F42B 15/12; F42B 10/60; F42B 10/62; F41G 7/007
USPC ..... 102/374–384, 393, 473, 480, 489, 102/501–503, 372, 373; 244/3.1–3.3
See application file for complete search history.

(56) References Cited

U.S. PATENT DOCUMENTS

| | | | | |
|---|---|---|---|---|
| 3,260,205 | A * | 7/1966 | Dietrich | F42B 10/16 244/3.23 |
| 4,175,720 | A * | 11/1979 | Craig | F42B 10/14 244/3.28 |
| 4,588,145 | A * | 5/1986 | Inglis | F42B 10/16 244/3.23 |
| 4,673,146 | A * | 6/1987 | Inglis | F42B 10/16 244/3.23 |

(Continued)

*Primary Examiner* — Bernarr Gregory
(74) *Attorney, Agent, or Firm* — Michael C. Sachs

(57) ABSTRACT

A new mortar projectile for use to resupply various payloads to distant troops. The mortar projectile has the capability of rapidly and accurately transporting the payloads to forward disposed combatants without interference of terrain or enemy action. The mortar projectile includes a shell body for housing the payload to be delivered, and a GPS-guided parafoil for delivering the payload to the designated remote target location.

9 Claims, 8 Drawing Sheets

(56) References Cited

U.S. PATENT DOCUMENTS 4,778,127 A * 10/1988 Duchesneau ..... F42B 10/16 244/3.29
4,995,573 A * 2/1991 Wallow ..... F42B 10/06 244/3.24
5,657,947 A * 8/1997 Mayersak ..... F42B 15/01 244/3.19
6,126,109 A * 10/2000 Barson ..... F42B 10/14 244/3.28
6,237,496 B1 * 5/2001 Abbott ..... F42B 10/64 244/3.14
6,254,031 B1 * 7/2001 Mayersak ..... F41G 7/007 244/3.22
6,392,213 B1 * 5/2002 Martorana ..... F42B 15/105 244/3.1
6,588,700 B2 * 7/2003 Moore ..... F42B 10/14 244/3.27
6,695,252 B1 * 2/2004 Dryer ..... F42B 10/14 244/3.28
6,874,425 B1 * 4/2005 Doughty ..... F42B 12/62 102/393
6,931,994 B2 * 8/2005 Lloyd ..... F42B 12/64 102/489
7,004,073 B2 * 2/2006 Michel ..... F42B 12/62 102/393
7,024,998 B2 * 4/2006 Dryer ..... F42B 30/12 102/373
7,137,588 B2 * 11/2006 Humphrey ..... F42B 15/12 102/374
7,395,761 B2 * 7/2008 Bittle ..... F42B 12/62 102/489
7,418,905 B2 * 9/2008 Bootes ..... F42B 12/52 102/489
8,074,572 B1 * 12/2011 Bland ..... F42B 12/64 102/489
8,196,514 B2 * 6/2012 Gustafsson ..... F42B 12/62 102/489
8,237,096 B1 * 8/2012 Alexander ..... F42B 10/64 102/384

* cited by examiner

MORTAR PROJECTILE WITH GUIDED DECELERATION SYSTEM FOR DELIVERING A PAYLOAD

GOVERNMENTAL INTEREST

The invention described herein may be manufactured and used by, or for the Government of the United States for governmental purposes without the payment of any royalties thereon.

FIELD OF THE INVENTION

The present invention generally relates to the field of munitions such as tube-launched projectiles. Particularly, the present invention relates to a mortar projectile having a guided deceleration system, such as a parafoil, for delivering a payload to a remotely located target location.

BACKGROUND OF THE INVENTION

Conventional artillery systems with guided parafoils include, for example, the miniature parafoil ("Mosquito") system developed by Stara Technologies, and the miniature guided parafoil ("Snowflake") system developed by the Naval Postgraduate School and the University of Alabama at Huntsville. In addition, the precision airdrop ("JPADS") system, described in Robert Wright, et al., "Precision Airdrop System, 18th AIAA Aerodynamic Decelerator Systems Technology Conference and Seminar, AIAA 2005-1644, pages 1-14, 2005," can be used for aerial replenishment of large payloads, beyond the scope of what would fit into a mortar or artillery projectile.

These conventional systems are GPS guided. Of these systems, only the Mosquito and Snowflake systems fit into a mortar or an artillery projectile. However, the Snowflake and JPADS systems are not designed for high-G launch survivability. The Mosquito system is designed to be launched from a countermeasure-type environment which is significantly softer than the setback experienced during a high charge mortar launch.

Furthermore, another conventional means of rapid resupply is a helicopter airdrop. During this resupply, the drop site has to be set up and guarded during the delivery. This places the soldiers and assets in a vulnerable situation that is neither quick nor stealthy. The use of the helicopter could also be relatively expensive.

In terms of accuracy of the actual location of delivery, the variance increases with the increasing range of the projectiles. Factors that contribute to the increased variance are winds aloft (meteorological data), propellant temperature variations, and marginal errors in gun elevations. Winds aloft present one form of disturbance in that crosswinds can send a projectile left or right relative to the intended target, and head and tail winds can propel the projectile too far or too short of the intended target.

There is therefore a still unsatisfied need for a mortar projectile having a guided deceleration system, such as a parafoil, for accurately delivering a payload to a remotely located target location, without interference of terrain or enemy action.

SUMMARY OF THE INVENTION

The present invention addresses the concerns of the conventional delivery systems, and presents a new tube-launched (or mortar) projectile for use to resupply various payloads to distant troops. The mortar projectile has the capability of rapidly and accurately transporting the payloads to forward disposed combatants without interference of terrain or enemy action.

The mortar projectile includes a shell body for housing the payload to be delivered. As used herein, a payload includes but is not limited to logistic supplies, medical supplies, ammunition such as bullets and grenades, and other supplies that might be needed by the distant troops. Additionally, the payload could be data gathering equipment such as meteorological, surveillance. Alternatively, the invention could be weaponized.

To this end, the present invention includes a novel mortar shaped projectile for deploying an autonomous GPS guided parafoil while in flight. Once deployed, a guided decelerator system or aerial delivery system (ADS), will navigate to a downrange target via GPS guided parafoil and softly land a payload of replenishment ammunition, or consumables, to a stranded warfighter.

The mortar projectile is designed to withstand the loading associated with a mortar/artillery tube launch as well as an expulsion event. Additionally, the payload of ammunition is properly supported during the launch event so as to enhance the survivability of the ammunition. In order to adapt the present mortar projectile to a high-G launch, riser actuators and motors have to be specifically designed, a ruggedized battery has to be implemented, and the guidance electronics need to be hardened.

More specifically, the tube-launched (or mortar) projectile generally includes a payload deployment section, and a tail section that is secured to the payload deployment section. The payload deployment section separates (or is expelled) from the tail section during the flight. The descent of the separated payload deployment section is guided toward the distant target by means of a guided decelerator system that includes a steerable parafoil. The final delivery pattern is an elongated ellipse with the major axis in the direction of flight of the parafoil.

The shell body forms part of the payload deployment section, and houses the payload, It is made from a rigid, light weight material that is less dense than steel.

Although payload is described herein as including bullets or cartridges, it should be understood that the payload is not limited to these munitions. In general, the payload could include ammunition, equipment for data gathering, meteorological data measurement, surveillance, weaponized submunition, or any other suitable items that are amenable to be stored within the mortar projectile.

The payload deployment section further includes a deployment mechanism that is housed within the tail section, and a guided deceleration container that houses the steerable parafoil. The payload deployment section further includes a guidance decelerator system comprised of guidance electronics, a power supply, at least one servo motor, and a parafoil steering mechanism.

The payload deployment section also includes a payload container that houses the payload. The payload can range from a single cartridge to a plurality of various items. In a preferred embodiment, the payload includes an ammunition that is stored in the payload container and that is oriented rearwardly toward the tail section.

The payload container is fitted with a packaging assembly for securely supporting the payload. The packaging assembly includes a plurality of preformed chambers that are geometrically shaped to snuggly receive, support, and conform to the shape of the payload.

BRIEF DESCRIPTION OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

Similar numerals refer to similar elements in the drawings. It should be understood that the sizes of the different components in the figures are not necessarily in exact proportion or to scale, and are shown for visual clarity and for the purpose of explanation.

DETAILED DESCRIPTION OF PREFERRED EMBODIMENTS

Figure 1:
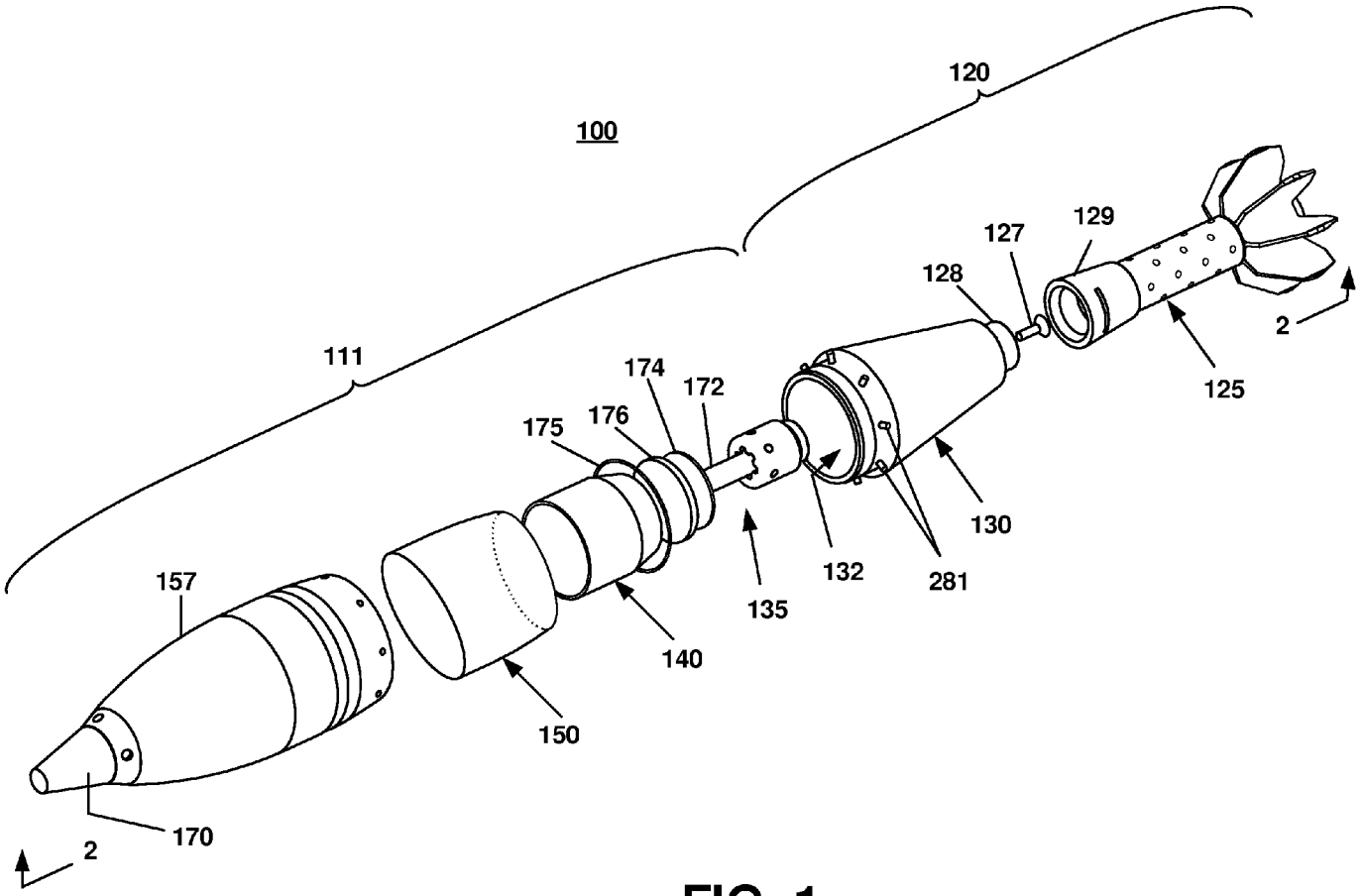
FIG. 1 is an exploded view of a mortar projectile according to the present invention, illustrating a payload deployment section and a tail section.
Figure 2:
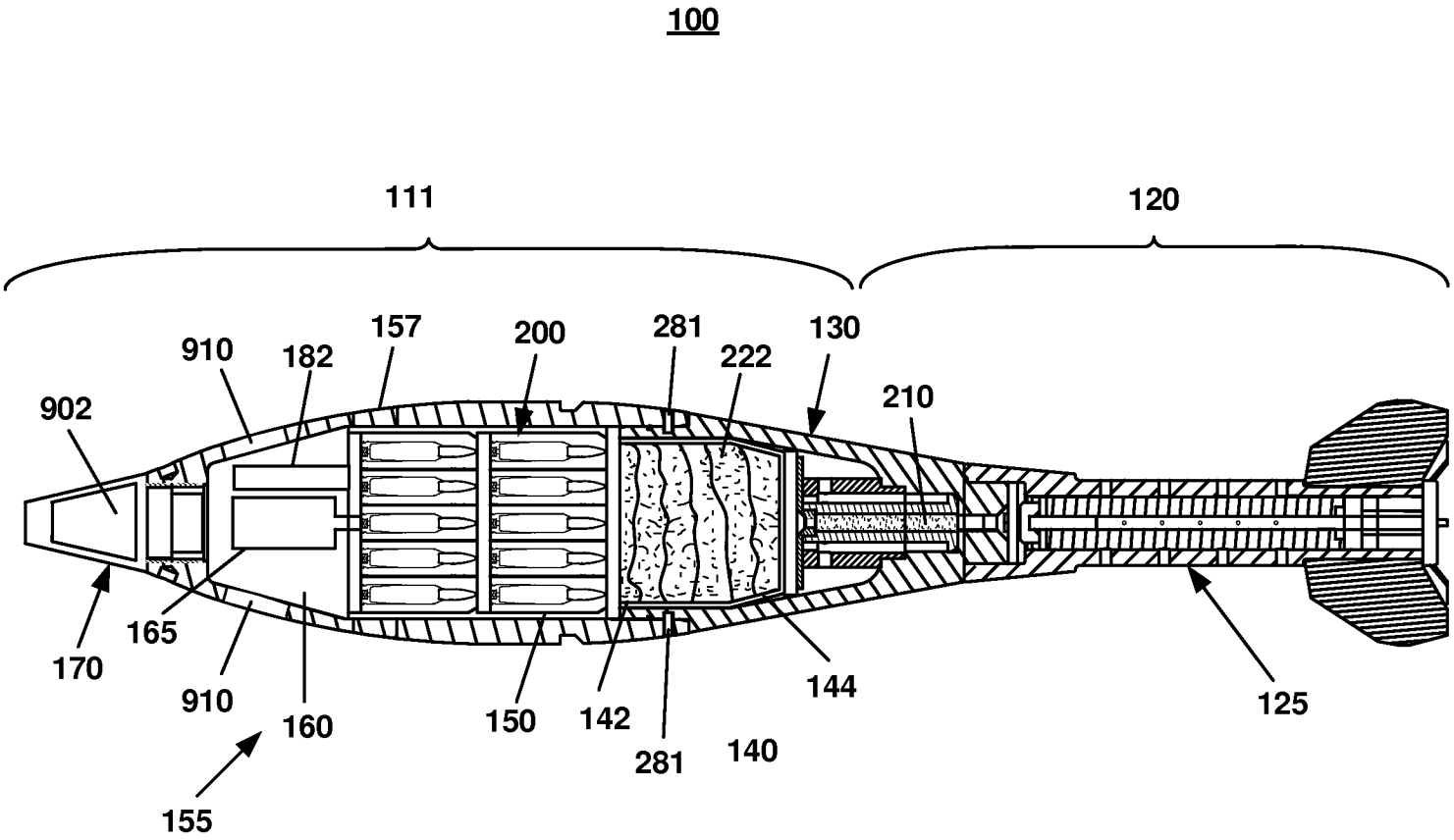
FIG. 2 is a cross-sectional view of the mortar projectile of FIG. 1, taken along line 2-2 thereof (with some of cross-hatching removed for clarity of illustration), showing a parafoil and a payload stored therein.
Figure 7:
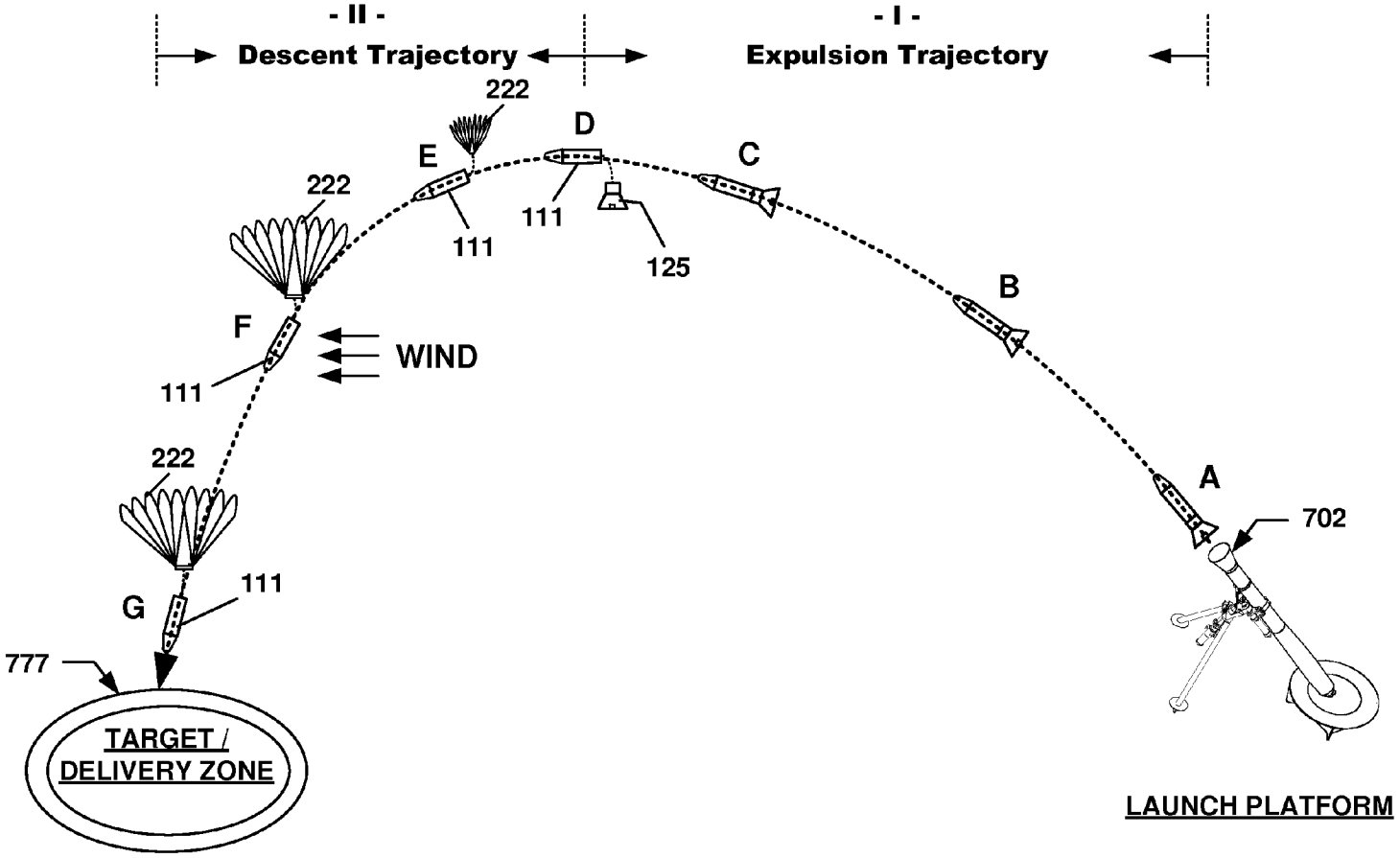
FIG. 7 illustrates an exemplary flight path of the mortar projectile of FIGS. 1 through 4.

With reference to FIGS. 1 and 2, the present invention provides a new mortar projectile 100 for use to deliver various payloads 200 to targeted distant troops 777 (FIG. 7). More specifically, the mortar projectile 100 has the capability of rapidly and accurately transporting the payloads 200 to forward disposed combatants 777 without interference of terrain or enemy action.

To this end, the mortar projectile 100 generally includes a payload deployment section (or forward section) 111, and a tail section (or aft section) 120. These two sections separate during flight, so that only the payload deployment section 111 is guided to the target 777.

The tail section 120 is generally comprised of a known or available fin and boom assembly 125 and a deployment housing 130 that are secured together so that the tail section 120 becomes an integral component. The deployment housing 130 is hollow and has a generally conical shape, so that at its narrower end, it includes a spacer shim 128 that fits into a receptacle 129 of the fin and boom section assembly 125.

The deployment housing 130 includes an inner deployment chamber 132. When the tail section 120 is assembled with the payload deployment section 111, the deployment housing 132 receives a deployment mechanism 135 of the payload deployment section 111, and a screw 127 secures the deployment housing 132 to the deployment mechanism 135.

The fin and boom assembly 125 is either frangible and/or uses a decelerator, such as a drogue chute 176 to slow its descent upon deployment of the payload deployment section 111, so as not to cause collateral damage. The trailing edges of the fins exhibit a bevel or cant angle that is sufficiently low (e.g., between about 1° and about 5°), in order to induce a very slow roll (e.g., a fraction of a Hertz) for dampening part of the asymmetric flight loads due to aerodynamics or physical balance.

The payload deployment section 111 generally includes, in addition to the deployment mechanism 135, a guided deceleration container (or housing) 140, a payload container 150, and a reusable nose section 155. The deployment mechanism 135 generally includes an ejection plunger 172, a pusher plate 174, and the drogue chute 176.

Figure 4:
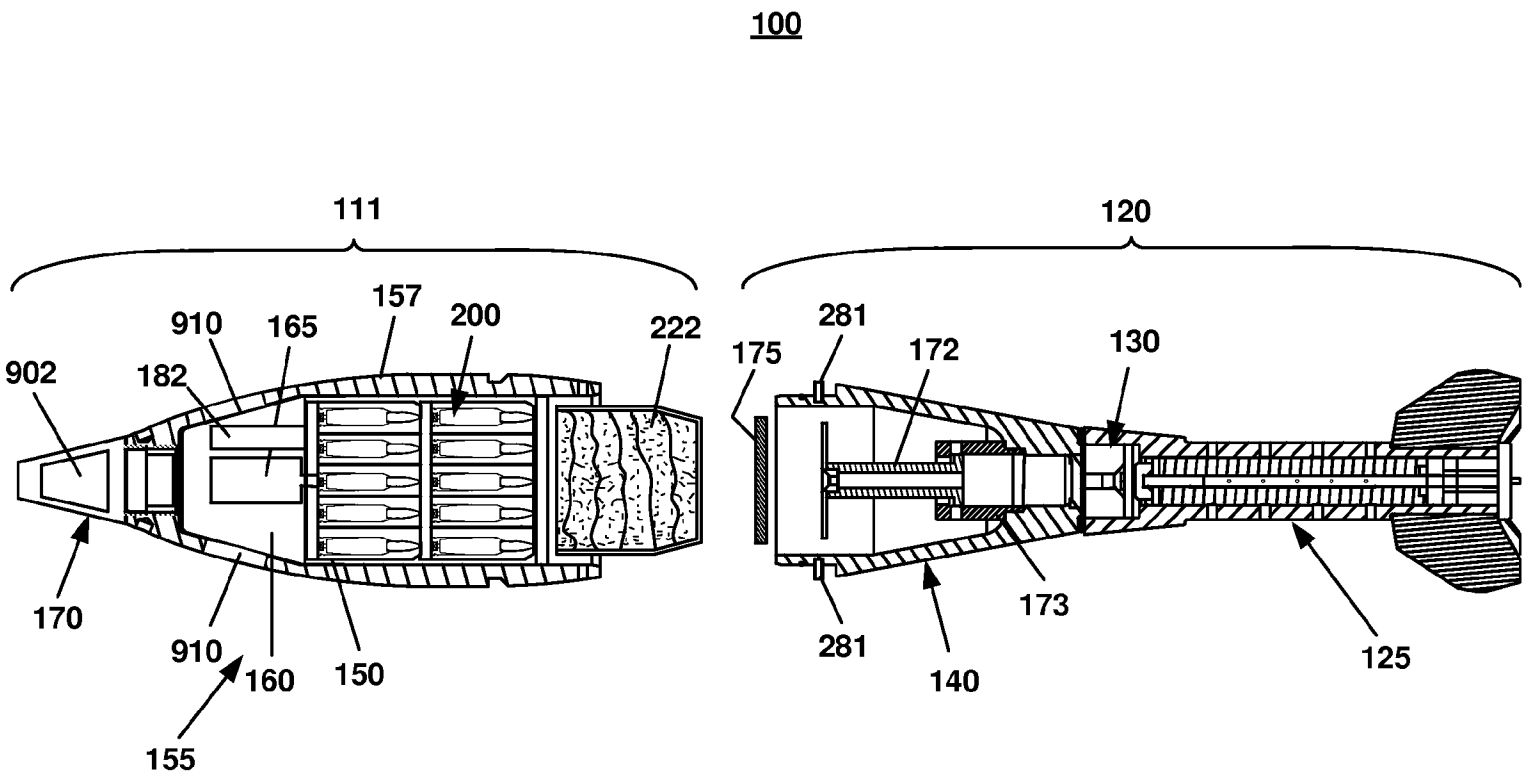
FIG. 4 is yet another view of the mortar projectile of FIG. 2, illustrating the separation (or expulsion) of the ammunition (e.g., 5.56 mm cartridges) payload deployment section from the tail section.

The guided deceleration container 140 is hollow and open-ended at both ends. As better illustrated in FIG. 2, the guided deceleration container 140 includes a generally conically shaped rearward section 144 that fits inside the deployment chamber 132 of the deployment housing 130. The rearward section 144 extends forwardly into a generally cylindrically shaped forward section 142. When the mortar projectile 100 is assembled, part of the forward section 142 fits within the deployment chamber 132, with the remaining structure fitting within a shell body 157 of the reusable nose section 155 (as also illustrated in FIG. 4).

The shell body 157 and the deployment housing 130 are preferably made of a material that enables the fabrication of a light weight, yet sturdy structure, (i.e., less dense than steel), so that the mortar projectile 100 is able to survive the high-G launch. The shell body 157 is readily accessible to allow rapid loading of different consumables or payloads 200.

Figure 3:
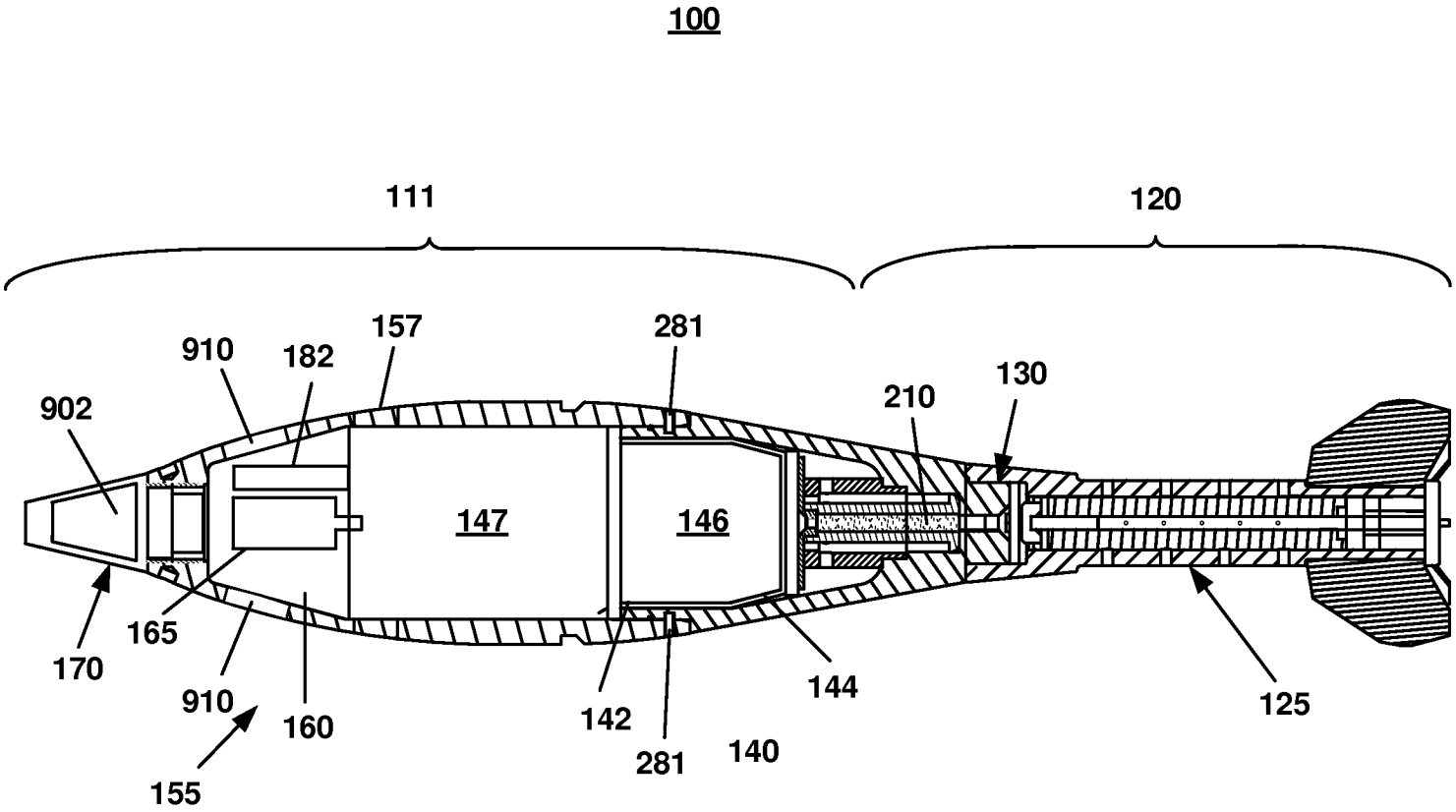
FIG. 3 is another view of the mortar projectile of FIG. 2, illustrating a payload container and a parafoil container without the payload or the parafoil.

As also illustrated in FIG. 3, the guided deceleration container 140 defines an internal parafoil chamber 146. In preparation for deployment, a means for decelerating the payload deployment section 111 toward the target 777, is stowed within the parafoil chamber 146. In a preferred embodiment, the deceleration means is a GPS-guided parafoil 222, which allows more guidance control over the descent flight path of the payload deployment section 111. In a simpler embodiment, the deceleration means could be, for example, a parachute.

The payload deployment section 111 further includes a payload container 150 that carries and provides safe support to the payload 200. As it will be further described in connection with FIGS. 5 and 6, the payload container 150 is generally cylindrically shaped, and fits tightly and securely within the shell body 157. As also illustrated in FIG. 3, the payload deployment section 111 defines an internal payload chamber 147 within which the payload 200 is housed.

In addition, the payload deployment section 111 includes a guided decelerator system 160 (reference is also made to FIG. 9) which is positioned within the shell body 157. The guided decelerator system 160 is intended to be located in the forward section of the light weight projectile body. The projectile body is comprised of the shell body 157, the deployment housing 130 and the tail section 120.

The forward section 111 includes a known or available impact absorbing tip 170 that deforms upon impact with the target 777, so that it absorbs the shock energy and prevents it from propagating to the guided decelerator system 160. As a result, the electronic components contained within the forward section 111 can be reused.

The guided decelerator system 160 (FIGS. 8, 9) generally includes a guidance and navigation system 182 (FIG. 2)

which is located in the nose section 155 (FIG. 2), the payload chamber 147 (FIG. 3) that houses the payload container 150, the parafoil 222, a riser mechanism that includes a plurality of parafoil risers 223 (FIG. 8), some of which are use for control and others for support, a deployment charge 210, and the ejection plunger 172.

Figure 8:
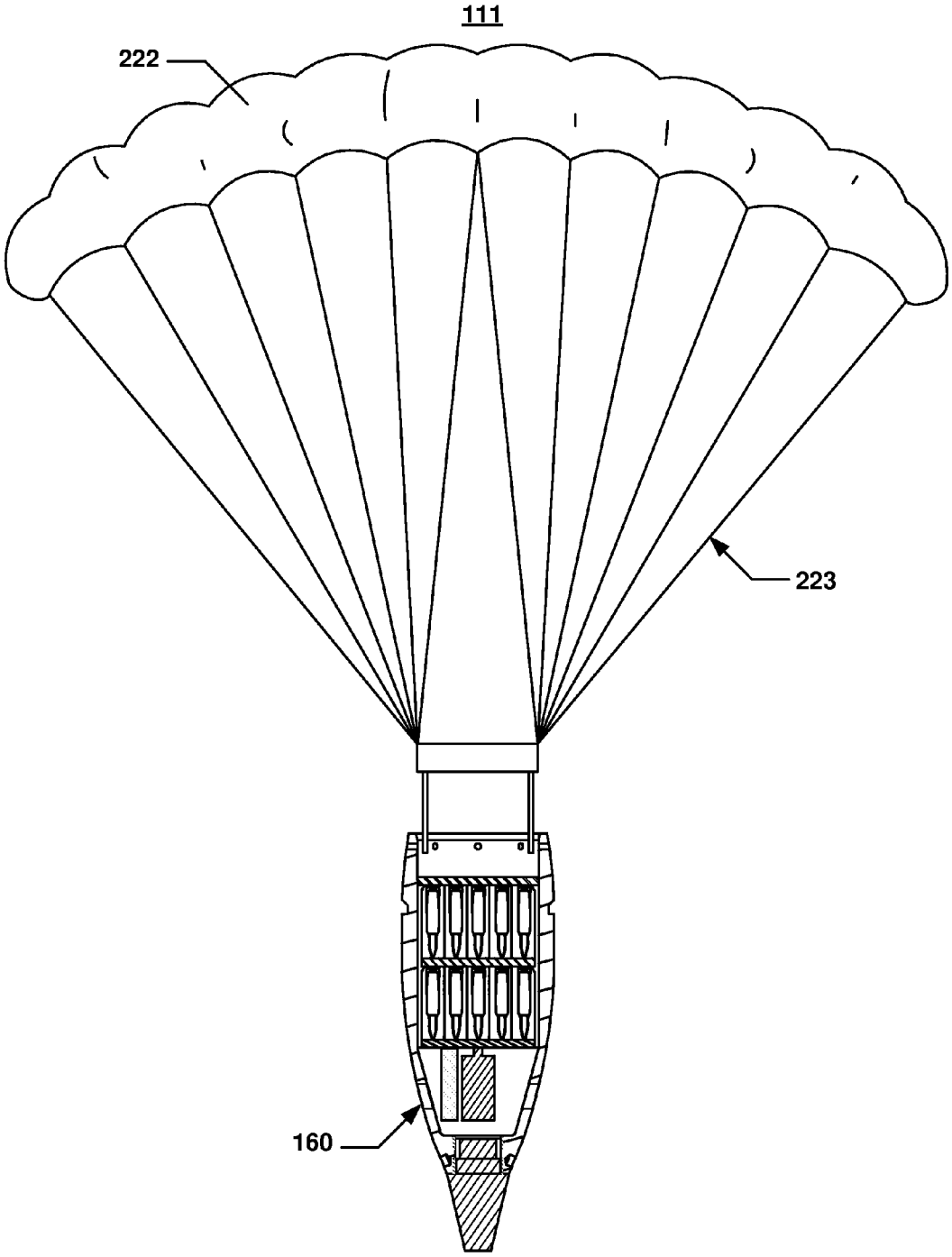
FIG. 8 is a cross-sectional view of the payload deployment section, illustrating a fully deployed parafoil.
Figure 9:
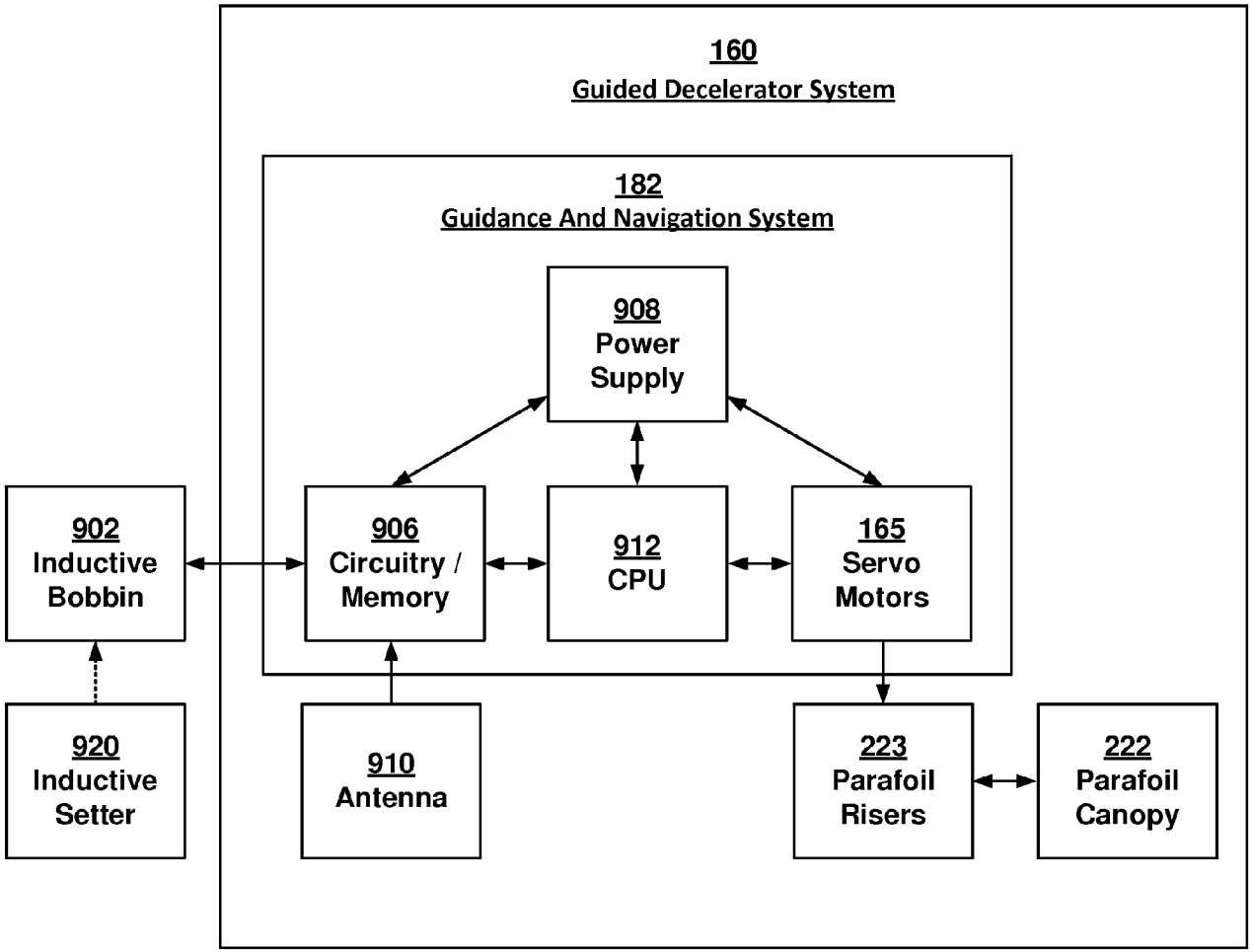
FIG. 9 is a high level block diagram of a guided decelerator system that is stowed in the forward section of the payload deployment section.

In use, and with further reference to FIGS. 7, 8, and 9, a request for resupply of ammunition or other expendables is received by a forward operating base (FOB). The payload container 150 of the payload deployment section 111 being readily accessible for loading the requested payload 200, is loaded accordingly. The call for resupply also provides the GPS coordinates of the target 777. The GPS information is loaded into the guidance and navigation system 182 via an inductive setter 920 that communicates with the guidance and navigation system 182 by means of an inductive bobbin 902.

The inductive bobbin 902 forms part of the guidance and navigation system 182 that further includes ruggedized servo motors 165, circuitry 906, a power supply such as a battery 908, and a CPU 912. These components are housed within the ogive-shaped section of the shell body 157. An antenna 910 also forms part of the guidance and navigation system 182, and is embedded within the shell body 157.

After launch from a mortar tube 702 (FIG. 7), and as illustrated by positions A, B, C, the GPS antenna 910 allows for the acquisition of GPS satellites for pre-deployment guidance. The aim point is selected so that the guided decelerator system 160 has optimal winds aloft. The time of separation of the payload deployment section 111 and the tail section 120 (position D), is determined by the guidance system algorithm stored on a memory within the circuitry 906. At the time of separation, a small explosive charge 210 is set off. The guidance system algorithm calculates the deployment time based upon the quadrant of elevation and the charge level for launching.

Preferably, the time of separation is about the apogee of the flight path (position D). At or near the maximum ordinate, the payload deployment section 111 and the tail section 120 separate, allowing the tail section 120 to decelerate via a drogue chute 175.

More specifically, the gas generated by the explosion of the charge 210 creates pressure that pushes the ejection plunger 172 forward with respect to the projectile shell body 157. The ejection plunger 172 applies a force on the guided deceleration container 140 housing the parafoil 222. In turn, the guided deceleration container 140 pushes on the payload container 150. A shearing load is created on the radially oriented pins 281 that retain the fin and boom assembly 125 of the tail section 120 assembled to the shell body 157. As a result of the shearing load, the pins 281 that retain the payload deployment section 111 shear, causing the tail section 120 to separate from the shell body 157.

With further reference to FIG. 4, following the separation event, the ejection plunger 172 is fully extended and captured by its own housing 173. The small drogue chute 175 is shown folded but ready to be deployed to slow the descent of the tail section 120 to a less than lethal velocity.

The payload deployment section 111 continues its flight forward until the parafoil housing 140 is discarded and the parafoil canopy 222 is un-reefed. At this point, the payload deployment section 111 is located at point E in the intended flight path as illustrated in FIG. 7. As further illustrated, between points E and F, in FIG. 7, the payload deployment section 111 guides under inertial measurement unit (IMU) of the guidance and navigation system 182.

During this time, the onboard global positioning system (GPS) is acquiring signals from the satellites. Upon GPS satellite signals acquisition at location F, the onboard algorithm will make corrections based on its own wind measurements and determine an optimal approach to the target 777, landing in the upwind direction. Once the payload deployment section 111 is delivered to the target location 777, at position G, the recovered payload deployment section 111, with the exception of the tip 170, may be reused. A new power supply or battery 908, a new payload 200, and a new tail section 120 will be required for another delivery mission.

One of the design concerns that the present invention overcame, is the GPS signal acquisition. GPS guided missiles and artillery projectiles are typically provided with a GPS signal prior to launch. For the purpose of the present invention, the guidance and navigation system 182 is integral with the mortar projectile shell body 157. This prohibits the guidance and navigation system 182 from acquiring GPS signal during launch.

In addition, the present mortar projectile 100 incorporates a wrap around GPS antenna 910 into the shell body 157 (FIG. 2) of the mortar projectile 100, with the other guidance electronics and components (i.e., the inductive bobbin 902, the ruggedized servo motors 165, the circuitry and memory 906, the power supply 908, and the processor 912) being incorporated into the shell body 157.

In an alternative embodiment, the GPS antenna 210 is incorporated into a fuze-like section on the front end of the shell body 157. Additionally, this fuze-like section could contain an inductive setter interface, which is common with other modern fuzes, thus allowing programming information to be entered into the present mortar projectile 100 prior to launch.

If GPS signals are not acquired during the initial launch and ballistic trajectory event, then upon deployment of the parafoil 222, an additional guidance tactic will be required for the first 20 seconds; otherwise the mortar projectile 100 might drift with the wind and potentially out of range from the target 777. To this end, the guidance and navigation system 182 will be provided with an ultra-light-weight (ULW) aerial deliver system (ADS), which is equipped with a sophisticated inertial measurement unit (IMU) so that it can guide the parafoil 222 in a pre-determined direction, regardless of shifts in the wind direction at high-altitudes.

Another design concern that is addressed by the present invention is the ability of the components of the mortar projectile 100 to survive a cannon launch, where axial accelerations are experienced as high as 18,000 Gs. This high pressure could pose a threat to both the guidance and navigation system 182 and the payload 200.

With regard to the guidance and navigation system 182, all the electronic components are secured, ensuring the absence of loose wires. Additionally, the riser mechanism for controlling the parafoil risers 223 (FIG. 8) and the power supply 908 are sufficiently rugged to survive the cannon launch loads.

Figure 5:
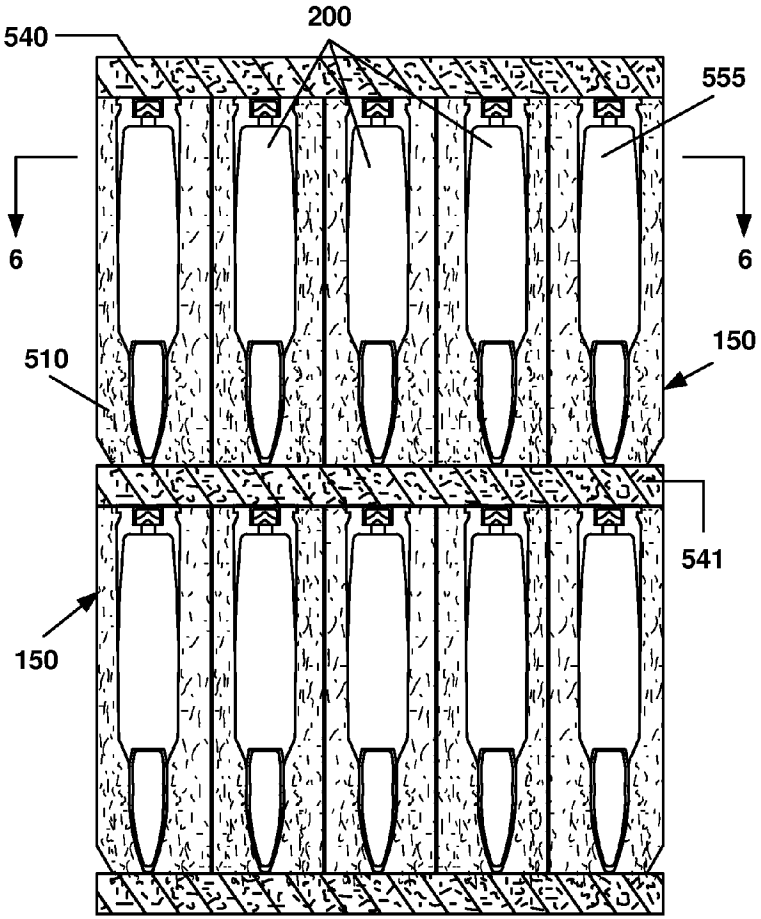
FIG. 5 is an enlarged cross-sectional view of an ammunition payload container, illustrating the payload.
Figure 6:
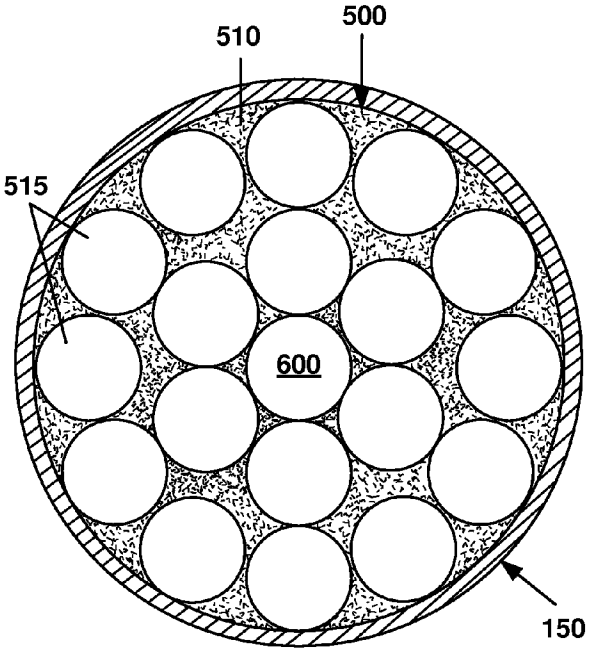
FIG. 6 is a cross-sectional view of the ammunition payload chamber of FIG. 5, taken along line 6-6 thereof, without the payload.

To this end, reference is now made to FIGS. 5 and 6 which illustrate a preferred means to package the payload 200 (e.g., ammunition) in order to survive the cannon launch, because loosely supported ammunition will be damaged, unsafe and therefore unusable.

The desired cargo must be properly supported during the launch event, but must also be easy to access and reload. Initial test results indicate that cartridge based ammunition, like the M855-5.56 mm, must be launched with the bullet oriented aftward with respect to projectile launch. The cartridge shoulder and the bullet must be supported simultaneously or the cartridge will debullet. The cartridge needs to be restrained axially. Testing has indicated that the cartridges will survive loads associated with a mortar launch. If the cartridges are to be fired in an artillery shell, the side walls of the cartridge casings have to be supported to keep the cases from crimping and acquiring damage.

To this end, the payload container 150 is fitted with a packaging assembly 500 for an exemplary payload, e.g., M855 cartridges 555. The payload 200 is contained within the payload container 150 that contains a packaging insert 510. The packaging insert 510 includes a plurality of preformed chambers 515 that are shaped to receive specific cartridges 555. FIG. 6 illustrates the preformed chambers 515 that are capable of carrying M855 ammunition. Packaging could be reconfigured to carry any other ammunition such as grenades. A central channel 600 is included to house the riser mechanism.

Each cartridge 555 is contained within a dedicated chamber, e.g., 515 of the packaging insert 510. The chamber 515 is conformly shaped to tightly match the dimensions and shape of the desired cartridge 555. Preferred, exemplary materials for the packaging insert 510 include hard rubber or supportive polymer.

The packaging assembly 500 further includes an endcap 540 that keeps the cartridge 555 from sliding out of its chamber 515. A conformal support simultaneously supports the cartridge 500 and its shoulder. A preferred, exemplary material for the endcap 540 includes hard rubber or supportive polymer. Another endcap 541 of similar composition to the endcap 540, is placed on the forward end of the cartridges 555 to complete the containment of the payload 200.

While FIG. 5 illustrates the payload 200 as including a plurality of items, it should be understood that the payload 200 may consist of a single item.

The entire payload 200, the payload deployment section 111, and the guidance and navigation system 182 fit within the limited cargo space of the mortar projectile 100. As an example, for an M930, 120 mm mortar projectile, this corresponds to a maximum of 115 $in^3$ of available space. As a result, the present invention utilizes the entire forward body section of the new mortar projectile 100 as the payload and guidance system container. This provides more room for the payload 200 and the guidance hardware, in addition to allowing easier extraction of the payload 200. As the payload 200 is intended to land gently near the stranded soldier 777, the payload deployment section 111 is designed to be recoverable and reusable.

FIG. 8 illustrates the guided decelerator system 160 with the parafoil 222 fully deployed and filled with air. At this point, the guided decelerator system 160 initiates control of the parafoil by means of the servo motors 165 and risers 223. GPS acquisition continues and the guided decelerator system 160 starts guiding toward the intended target 777.

It is to be understood that the phraseology and terminology used herein with reference to device, mechanism, system, or element orientation (such as, for example, terms like "front", "back", "up", "down", "top", "bottom", "forward", "rearward", and the like) are only used to simplify the description of the present invention, and do not alone indicate or imply that the mechanism or element referred to must have a particular orientation. In addition, terms such as "first", "second", and "third" are used herein and in the appended claims for purposes of description and are not intended to indicate or imply relative importance or significance.

It is also to be understood that the invention is not limited in its application to the details of construction and the arrangements of components set forth in the following description or illustrated in the drawings. Other modifications may be made to the present design without departing from the spirit and scope of the invention. The present invention is capable of other embodiments and of being practiced or of being carried out in various ways, such as, for example, in military and commercial applications.

What is claimed is:

1. A tube-launched projectile used in a flight to deliver a payload to a distant target, the projectile comprising:

a payload deployment section; and a tail section that is secured to the payload deployment section, and;

wherein the payload deployment section includes a deployment mechanism that is housed within the tail section, and wherein the payload deployment section also includes a guidance decelerator system and a guided deceleration container therein, and wherein the guidance decelerator system further includes a guidance and navigation system, and wherein the guidance and navigation system further includes guidance electronics, a power supply, and a parafoil steering mechanism, and wherein the guidance and navigation system furthermore provides guidance by means of an inertial measurement unit and a GPS unit, and;

wherein the payload deployment section is separated from the tail section during the flight by the deployment mechanism, and wherein the guided deceleration container further houses a parafoil therein controlled by said parafoil steering mechanism which assists decelerating the descent of the separated payload deployment section, and;

wherein a descent of the separated payload deployment section is guided by said parafoil toward the distant target with aid of said guidance and navigation system; and wherein the payload deployment section includes a shell body that houses the payload.

2. The tube-launched projectile of claim 1, wherein the shell body is made from a rigid material that is less dense than steel.

3. The tube-launched projectile of claim 1, wherein the parafoil is a steerable parafoil.

4. The tube-launched projectile of claim 1, wherein the parafoil steering mechanism includes one or more ruggedized servo motors.

5. The tube-launched projectile of claim 1, wherein the payload deployment section further includes a payload container that houses the payload.

6. The tube-launched projectile of claim 5, wherein the payload includes ammunition.

7. The tube-launched projectile of claim 6, wherein the ammunition is stored in the payload container and is oriented rearwardly toward the tail section.

8. The tube-launched projectile of claim 7, wherein the payload container includes a packaging assembly for securely supporting the payload.

9. The tube-launched projectile of claim 8, wherein the packaging assembly includes a plurality of preformed chambers that are geometrically shaped to snuggly receive and support a shoulder, a sidewall, and an end of the payload.

* * * * *